United States Patent [19]

Arbuckle

[11] 4,117,594

[45] Oct. 3, 1978

[54] GUIDE BAR MOUNT FOR CHAIN SAW

[75] Inventor: James A. Arbuckle, Omro, Wis.

[73] Assignee: Textron Inc., Providence, R.I.

[21] Appl. No.: 843,954

[22] Filed: Oct. 2, 1977

[51] Int. Cl.[2] ..... B27B 17/02

[52] U.S. Cl. ..... 30/381

[58] Field of Search ..... 30/381, 382, 383, 384, 30/385, 386, 387

[56] References Cited

U.S. PATENT DOCUMENTS

| | | | |
|---|---|---|---|
| 3,651,839 | 3/1972 | Stihl | 30/381 |
| 3,680,608 | 8/1972 | Emmerich | 30/381 |
| 3,849,883 | 11/1974 | Kolorz | 30/381 |
| 3,934,344 | 1/1976 | Inaga | 30/381 |
| 4,015,544 | 3/1977 | Siman | 30/381 |

FOREIGN PATENT DOCUMENTS

| | | | |
|---|---|---|---|
| 649,018 | 9/1962 | Canada | 30/381 |

*Primary Examiner*—Jimmy C. Peters

*Attorney, Agent, or Firm*—Robert E. Burns; Emmanuel J. Lobato; Bruce L. Adams

[57] ABSTRACT

Pads of vibration damping material between the rear end of the guide bar and the case of a chain saw and between the rear end of the guide bar and the drive case cover reduce the transmission of guide bar, chain and sprocket vibration and noise to the chain saw case.

7 Claims, 3 Drawing Figures

GUIDE BAR MOUNT FOR CHAIN SAW

FIELD OF INVENTION

The present invention relates to a guide bar mount for a chain saw and particularly to means for reducing transmission of guide bar, chain and sprocket noise and vibration to the power head of the chain saw.

BACKGROUND OF THE INVENTION

In recent years greater attention has been paid to protecting the user of a hand-held chain saw from vibration generated by the chain saw. In a chain saw powered by an internal combustion engine —commonly a single cylinder two-stroke cycle engine— the engine is a primary source of vibration. In order to protect the user from such vibration means is provided for isolating the engine from a unit comprising the fuel tank, oil tank and handles by which the chain saw is held.

A further source of vibration and noise is the chain and guide bar assembly comprising the guide bar, the cutting chain which runs on the guide bar and the sprocket by which the chain is driven. As the chain is driven at high speed by the drive sprocket, a considerable amount of noise and vibration are generated by engagement of the sprocket teeth with the chain, by the chain running on the guide bar and around the nose of the guide bar which may or may not be provided with a nose sprocket or roller and by engagement of the teeth of the chain in rapid succession with the work.

Heretofore the guide bar has been mounted rigidly on the power head of the chain saw, for example by being bolted together with a drive case cover onto the engine casing. By reason of this rigid mounting, vibration and noise generated in the guide bar assembly is transmitted to the powerhead of the chain saw which tends to amplify the vibration and noise in somewhat the same manner as the shell of a violin. The vibration and noise of the guide bar assembly as thus amplified contributes in a significant way to the overall vibration problem. However, heretofore little or no attention has been paid to elimination or reduction of guide bar vibration and noise.

The problem of dealing with vibration and noise generated in the guide bar assembly is rendered more difficult by the fact that the guide bar needs to be connected with the powerhead in such manner that the operator has effective control of the cutting of the chain saw. Since the guide bar and chain running thereon constitute the cutting element of the chain saw, the operator needs to be able to control accurately the position and angle of the guide bar in order to cut at the location and in the direction desired. If the interconnection between the guide bar and the handles on the powerhead were too "soft" the operator would not have adequate control of the cutting operation.

SUMMARY OF THE INVENTION

It is an object of the present invention to effect a significant reduction in the transmission to the powerhead of a chain saw of the vibration and the noise generated in the guide bar assembly and thereby reduce the vibration and noise to which the operator of the chain saw is subjected. A further object of the invention is to effect such reduction in vibration and noise while at the same time providing full and effective control by the operator of the cutting of the chain saw.

In accordance with the invention pads of vibration damping material are interposed between the rear end of the guide bar and the causing of the powerhead on which the guide bar is mounted and between the rear end of the guide bar and a drive case cover which together with the guide bar is mounted on the powerhead casing. In this manner the transmission of guide bar, chain and sprocket vibration and noise to the powerhead of the chain saw is greatly reduced.

BRIEF DESCRIPTION OF DRAWINGS

The nature, objects and advantages of the invention will be more fully understood from the following description of a preferred embodiment of the invention shown by way of example in the accompanying drawings in which.

DESCRIPTION OF PREFERRED EMBODIMENT

Figure 1:
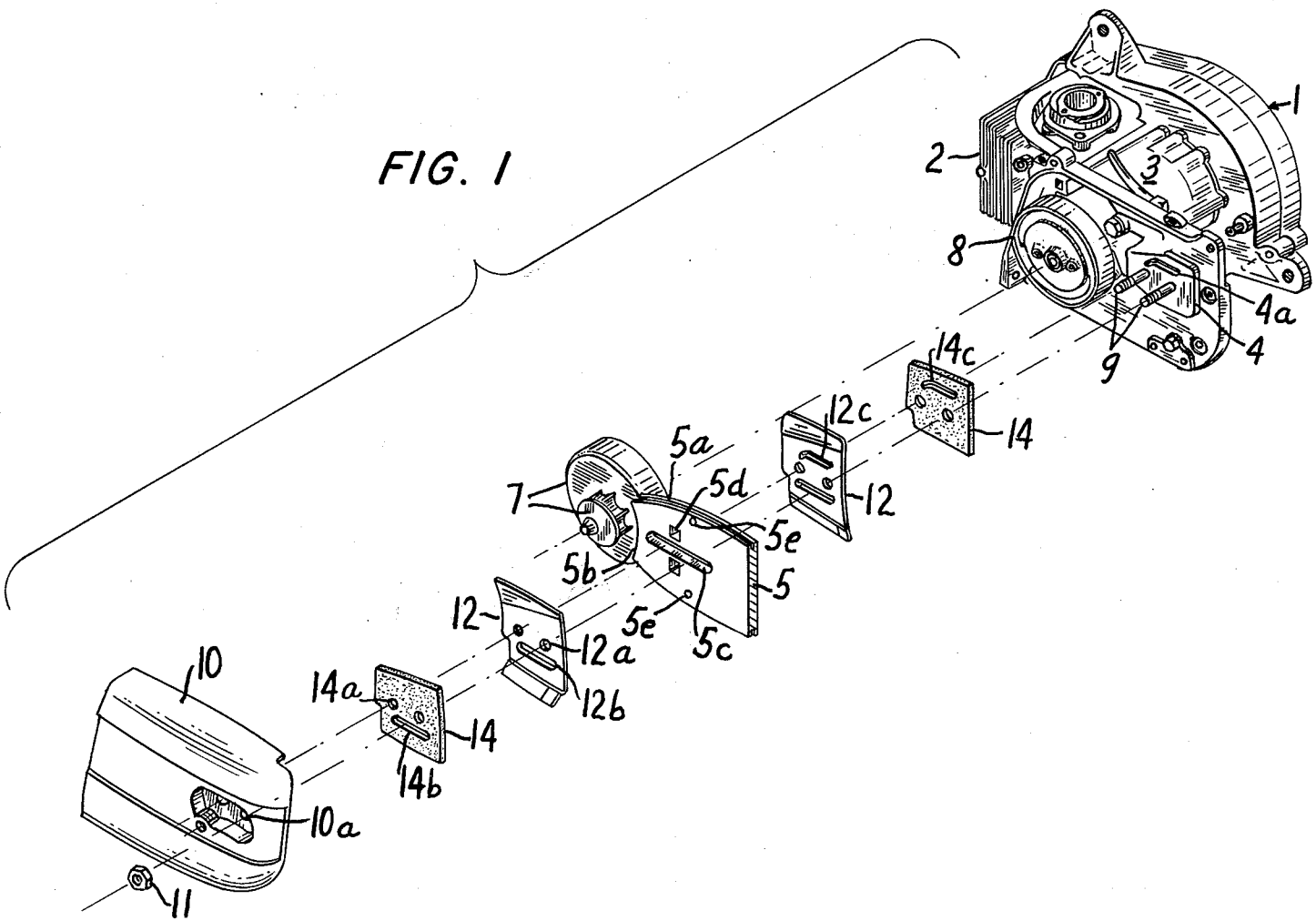
FIG. 1 is a schematic exploded view showing the mounting of a guide bar on the powerhead of a chain saw in accordance with the invention.

In FIG. 1 there is shown a portion of the powerhead of a hand-held chain saw comprising an engine 1 having a cylinder 2 and a case 3. On one side of the engine case there is provided a flat surface 4 for supporting a guide bar 5 of which only a rear end portion is shown in the drawings.

The guide bar 5 is an elongate bar having in its periphery a groove **5*a* for guiding a cutting chain 6 which runs around the bar. The front end of the bar may be suitably rounded or provided with a nose sprocket or roller for supporting and guiding the chain as it passes around the end of the bar. At its rear end the bar is provided with a concave surface 5*b* to accommodate a sprocket 7 by which the chain is driven. The sprocket 7 is mounted on the driven portion of a centrifugal clutch 8** provided on the engine and driven by the engine crank shaft.

Figure 2:
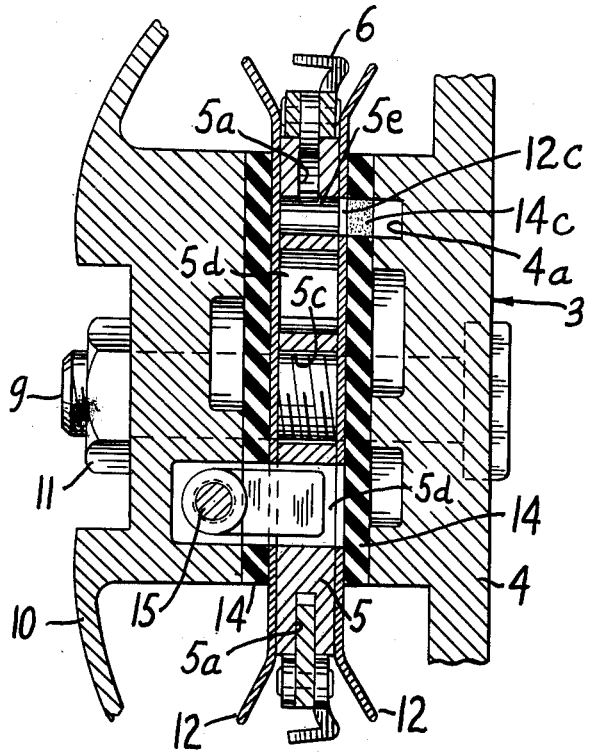
FIG. 2 is a cross section on line 2—2 in FIG. 3 through the rear end of the guide bar and adjacent portions of the mounting.
Figure 3:
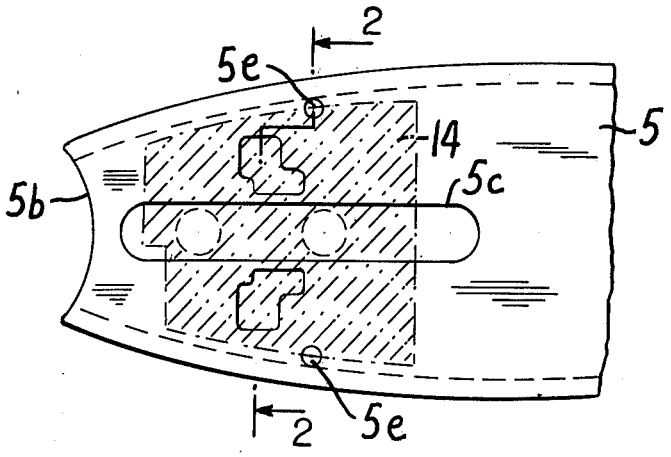
FIG. 3 is an elevation of a rear end portion of the guide bar showing the location of vibration isolating pads.

The rear end portion of the guide bar 5 is provided with a longitudinally extending elongate slot **5*c* for receiving bolts 9 which project from the guide bar mounting surface 4 of the enginge case 3. The slot 5*c* is of sufficient length to permit longitudinal adjustment of the guide bar for adjustment of chain tension by adjusting means 15 (FIG. 2) which engages in one or another of recesses 5*d* provided at opposite sides of the slot 5*c*, two such recesses being provided in order for the guide bar to be reversible. The rear end portion of the guide bar is further provided with small holes 5*e* which extend into the peripheral slot 5*a* and —when the guide bar is mounted on the powerhead— communicate with a recess 4*a* in the supporting surface 4** in order to supply oil for lubricating the guide bar and chain.

The bolts 9 on the supporting surface 4 extend through the longitudinally extending slot **5*c* in the rear end portion of the guide bar 5 and through holes 10*a* in a drive case cover 10 which covers the rear end portion of the guide bar, the drive sprocket 7 and the centrifugal clutch 8. Nuts 11 screw on the bolts 9 so as to secure the guide bar 5 and drive case cover 10 on the powerhead of the chain saw. Chain guides or shims 12 provided on opposite sides of the rear end portion of the guide bar 5** serve to guide the chain as it leaves and returns to the guide bar in passing around the drive sprocket 7. The shims 12 are provided with holes 12*a* for the bolts 9 and with an elongate slot 12*b* to accommodate the guide bar adjusting means. At least the inboard shim is also provided with a slot 12*c* to permit passage of lubricating oil from the recess 4*a* in the guide bar supporting surface 4 to the lubricating hole 12*e* provided in the guide bar. In accordance with the present invention there are also provided on opposite sides of the rear end portion of the guide bar 5 pads 14 of vibration damping material. One of the pads 14 is provided between the guide bar 5 and the guide bar supporting surface 4 of the powerhead while the other is provided between the guide bar and the drive case cover 10. As shown by way of example in FIG. 1, the pads 14 are outside the shims 12. However, the pads can be between the shims 12 and the guide bar if so desired or the shims 12 may be omitted.

The pads 14 of vibration damping material are shown as having a size and shape corresponding generally to the guide bar supporting surface 4 of the powerhead. They are provided with holes 14*a* for passage of the bolts 9 and at least the outboard pad is provided with a slot 14*b* to accommodate the guide bar adjusting mechanism. At least the inboard pad is provided with a slot 14*c* to permit passage of oil from the recess 4*a* in the guide bar supporting surface of the powerhead to one of the lubricating holes 5*e* of the guide bar.

The vibration damping pads 14 are formed of any material having suitable vibration isolating qualities. A suitable material is an elastomer, for example synthetic rubber, which has suitable vibration isolating characteristics and is resistant to oil. The thickness of the pads and the firmness of the material are selected so as to provide effective vibration isolation while at the same time holding the guide bar sufficiently firmly to assure effective control of the cutting by the operator. By way of example it has been found that rubber pads having a durometer of about 60 and a thickness of about 0.060 inch are satisfactory.

The vibration isolation pads can be conveniently die cut from suitable sheet material. If the material of which the vibration isolating pads 14 are formed has a tendency to cold flow, provision is made for inhibiting such flow of the material under the pressure exerted by the bolts 9 and nuts 11. For example the pads 14 may be bonded for example by adhesive or vulcanizing either to the surfaces of the shims 12 or to the pad-engaging surfaces of the powerhead case and drive case cover. Alternatively, the vibration isolation pads 14 may be framed for example with plastic material or elastomeric material having a higher durometer.

It has been found that the pads 14 of vibration damping material between the rear end of the guide bar and the supporting surfaces by means of which the guide bar is mounted on the power head effectively reduce the transmission of guide bar, chain and sprocket vibration and noise to the powerhead and hence to the operator. It will be understood that the powerhead includeds suitable fuel and oil tanks and suitable handles (not show) for holding the chain saw when it is being used.

While a preferred embodiment of the invention has been illustrated in the drawings and is herein particularly described, it will be understood that variations and modifications may be made and hence the invention is in no way limited to the illustrated embodiment.

What is claimed is:

1. In a chain saw comprising a powerhead with a case having a support surface for mounting a guide bar thereon, a guide bar having an apertured rear end portion for mounting on said support surface, a cover for the rear end portion of said guide bar, and bolt means for securing said cover to said motor case with the rear end portion of said guide bar therebetween, said bolt means passing through an aperture in said guide bar, the improvement which comprises interposing a pad of vibration damping material between said guide bar and said support surface of said motor case and a pad of vibration damping material between said guide bar and said cover, whereby said guide bar is gripped between said pads of vibration damping material and is thereby vibration-isolated from said powerhead case.

2. A chain saw according to claim 1, in which said vibration damping material is an elastomer of a durometer value and thickness to provide effective vibration isolation while holding the guide bar firmly to provide effective control of cutting by the chain saw.

3. A chain saw according to claim 1, in which said pads are formed of elastomeric material having a durometer value of about 60 and a thickness of about 0.060 inch.

4. A chain saw according to claim 1, in which at least one of said pads has a slot extending lengthwise of the guide bar to accommodate means for adjusting said guide bar in a lengthwise direction.

5. A chain saw according to claim 1, in which at least one of said pads has an aperture for transmission of lubricating oil to the guide bar from said motor case.

6. A chain saw according to claim 1, further comprising chain-guiding shims between said pads and said guide bar.

7. A chain saw according to claim 1, further comprising means for inhibiting cold flow of the material of said pads.

* * * * *